US011160304B2

(12) United States Patent
Shinozaki et al.

(10) Patent No.: US 11,160,304 B2
(45) Date of Patent: Nov. 2, 2021

(54) SMOKELESS FLAVOR INHALATOR

(71) Applicant: JAPAN TOBACCO INC., Tokyo (JP)

(72) Inventors: Yasuhiro Shinozaki, Tokyo (JP); Kazuhiko Katayama, Tokyo (JP); Takeshi Akiyama, Tokyo (JP); Yoshiaki Ishikawa, Tokyo (JP); Manabu Yamada, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 617 days.

(21) Appl. No.: 16/038,877

(22) Filed: Jul. 18, 2018

(65) Prior Publication Data

US 2018/0317560 A1 Nov. 8, 2018

Related U.S. Application Data

(60) Division of application No. 13/720,081, filed on Dec. 19, 2012, now abandoned, which is a continuation of application No. PCT/JP2011/004299, filed on Jul. 28, 2011.

(30) Foreign Application Priority Data

Jul. 30, 2010 (JP) ..... 2010-172338

(51) Int. Cl.
*A24D 1/22* (2020.01)

(52) U.S. Cl.
CPC ..... *A24D 1/22* (2020.01)

(58) Field of Classification Search
None
See application file for complete search history.

(56) References Cited

U.S. PATENT DOCUMENTS

| | | | |
|---|---|---|---|
| 4,793,365 | A | 12/1988 | Sensabaugh, Jr. et al. |
| 4,827,950 | A | 5/1989 | Banerjee et al. |
| 4,854,331 | A | 8/1989 | Banerjee et al. |
| 4,892,109 | A | 1/1990 | Strubel |
| 4,924,883 | A | 5/1990 | Perfetti et al. |
| 4,955,399 | A | 9/1990 | Potter et al. |

(Continued)

FOREIGN PATENT DOCUMENTS

| | | | |
|---|---|---|---|
| CN | 1039710 | A | 2/1990 |
| CN | 1195270 | A | 10/1998 |

(Continued)

OTHER PUBLICATIONS

European Patent Office, "Communication with Extended European Search Report," issued in connection with European Patent Application No. 11812088.0, dated Jan. 25, 2017.

(Continued)

*Primary Examiner* — Michael J Felton
(74) *Attorney, Agent, or Firm* — Birch, Stewart, Kolasch & Birch, LLP

(57) ABSTRACT

A smokeless flavor inhalator includes a tobacco material as a flavor generator, and a heater for heating the tobacco material to allow flavor components to be released from the tobacco material while preventing smoke from being generated from the tobacco material. The heater has a carbon heat source and a cooling element. The carbon heat source and the cooling element cooperatively keep the heating temperature of the tobacco material at a temperature of 50 to 200° C.

20 Claims, 12 Drawing Sheets

(56) References Cited

U.S. PATENT DOCUMENTS

| | | | | |
|---|---|---|---|---|
| 4,981,522 | A | 1/1991 | Nichols et al. | |
| 4,991,606 | A | 2/1991 | Serrano et al. | |
| 5,027,837 | A * | 7/1991 | Clearman | A24D 1/22 131/359 |
| 5,060,671 | A | 10/1991 | Counts et al. | |
| 5,099,861 | A | 3/1992 | Clearman et al. | |
| 5,144,962 | A | 9/1992 | Counts et al. | |
| 5,345,955 | A | 9/1994 | Clearman et al. | |
| 5,396,911 | A | 3/1995 | Casey, III et al. | |
| 5,469,871 | A | 11/1995 | Barnes et al. | |
| 5,845,649 | A * | 12/1998 | Saito | A24B 15/165 131/352 |
| 2004/0081933 | A1 | 4/2004 | St. Charles et al. | |
| 2004/0226568 | A1 | 11/2004 | Takeuchi et al. | |
| 2006/0118128 | A1 | 6/2006 | Hoffmann et al. | |
| 2007/0215168 | A1* | 9/2007 | Banerjee | A24D 3/067 131/335 |
| 2011/0030707 | A1* | 2/2011 | Tsuruizumi | A24C 5/00 131/328 |

FOREIGN PATENT DOCUMENTS

| | | | |
|---|---|---|---|
| CN | 1607911 | A | 4/2005 |
| EP | 0 174 645 | A2 | 3/1986 |
| EP | 0 532 194 | A1 | 3/1993 |
| EP | 0 588 247 | A2 | 3/1994 |
| EP | 1 468 618 | A1 | 10/2004 |
| JP | 62-501050 | A | 4/1987 |
| JP | 63-35468 | A | 2/1988 |
| JP | 2-2331 | A | 1/1990 |
| JP | 2-84164 | A | 3/1990 |
| JP | 2-190171 | A | 7/1990 |
| JP | 3-45658 | B2 | 7/1991 |
| JP | 5-277191 | A | 10/1993 |
| JP | 6-46818 | A | 2/1994 |
| JP | 6-114105 | A | 4/1994 |
| JP | 3012253 | B2 | 12/1999 |
| JP | 3013914 | B2 | 12/1999 |
| JP | 2006-504065 | A | 2/2006 |
| JP | 2006-525798 | A | 11/2006 |
| JP | 2008-35742 | A | 2/2008 |
| TW | 336885 | | 7/1998 |
| WO | WO 03/056949 | A1 | 7/2003 |
| WO | WO 2004/080216 | A1 | 9/2004 |
| WO | WO 2007/012007 | A2 | 1/2007 |
| WO | WO 2008/113420 | A1 | 9/2008 |
| WO | WO 2009/022232 | A2 | 2/2009 |
| WO | WO 2009/079641 | A2 | 6/2009 |
| WO | WO 2009/092862 | A1 | 7/2009 |

OTHER PUBLICATIONS

Extended European Search Report for European Application No. 21154270.9, dated Apr. 14, 2021.

* cited by examiner

CARBON COMBUSTION+HIGH-TEMP. GAS HEATING+COOLING

CARBON COMBUSTION+HIGH-TEMP. GAS HEATING+COOLING

CARBON COMBUSTION+HIGH-TEMP. GAS/THERMAL CONDUCTION HEATING+COOLING

CARBON COMBUSTION+THERMAL CONDUCTION HEATING

CARBON COMBUSTION+THERMAL CONDUCTION HEATING

CARBON COMBUSTION+THERMAL CONDUCTION HEATING

CARBON COMBUSTION+AIR HEATING

SMOKELESS FLAVOR INHALATOR

CROSS REFERENCE TO RELATED APPLICATIONS

This application is a Divisional of U.S. patent application Ser. No. 13/720,081, filed Dec. 19, 2012, which is a Continuation of PCT International Application No. PCT/JP2011/00429, filed on Jul. 28, 2011, which claims priority under 35 U.S.C. § 119(a) to Patent Application No. 2010-172338 filed in Japan on Jul. 30, 2010, all of which are hereby expressly incorporated by reference into the present application.

TECHNICAL FIELD

The present invention relates to smokeless flavor inhalators capable of releasing flavor without generating aerosol to allow users to inhale and enjoy the released flavor.

BACKGROUND ART

Smoking articles such as cigarettes and cigars are typical flavor generation products using, as a medium, the smoke (aerosol) produced by the combustion of tobacco leaves to allow users to enjoy the flavor of tobacco through the senses of taste and smell.

Meanwhile, in recent years, there have been known a variety of substitutes for the smoking articles that allow the user to enjoy the flavor of tobacco. The substitutes for the smoking articles can be roughly classified into two types, non-heating type and heating type. In either type, tobacco leaves are not burned, and thus it is possible to prevent the sidestream smoke or smell of the burned tobacco leaves from affecting the people around the user.

For example, the non-heating type smoking article substitute disclosed in Patent Document 1 identified below includes a holder provided with an air inlet opening and a mouthpiece, and an air permeable vessel accommodated in the holder. The air permeable vessel is filled with a tobacco material impregnated with the flavor components of tobacco.

With the smoking article substitute of Patent Document 1, the user has only to inhale, through the mouthpiece, the air that has passed through the tobacco material, without lighting the tobacco material, to enjoy the flavor of tobacco contained in the air.

The heating-type substitutes for the smoking articles, on the other hand, can be classified in more detail according to the type of heat source and the method of transferring heat from the heat source to the tobacco material or the flavor generator.

Specifically, the smoking article substitutes disclosed in Patent Documents 2 to 6 use a carbon heat source. The carbon heat source heats air by utilizing the heat of combustion thereof, to produce a high-temperature gas flow for heating the tobacco material or the flavor generator. In the heating-type smoking article substitutes, the flavor components of tobacco are vaporized and released invariably by heating the tobacco material or the flavor generator.

The smoking article substitutes disclosed in Patent Documents 7 and 8 also use a carbon heat source. In these substitutes, heat generated by the combustion of the carbon heat source is transferred to the tobacco material or the flavor generator to heat same.

The smoking article substitutes disclosed in Patent Documents 9 to 13 use a liquid or gas fuel as the heat source.

Specifically, in the smoking article substitute of Patent Document 9, a liquid fuel is burned with the aid of a catalyst, and the tobacco material or the flavor generator is heated by a high-temperature gas flow created by the combustion heat of the liquid fuel.

The smoking article substitute of Patent Document 10 is equipped with a micro gas burner as an attachment, which is used to heat a cigarette.

In the smoking article substitutes of Patent Documents 10 to 12, butane gas is burned with the aid of a catalyst, and heat generated by the combustion of the gas is transferred to the tobacco material or the flavor generator to heat same.

The smoking article substitute of Patent Document 13 is provided with a heat sink, which stores heat therein as it is heated by the flame of a gas lighter (external heat source). The heat stored in the heat sink is transferred through a heat pipe to a volatile component (flavor generator) to heat same.

The smoking article substitutes disclosed in Patent Documents 14 to 17 are provided with a heat source utilizing the heat of chemical reaction. Specifically, in the smoking article substitutes of Patent Documents 14 and 15, the heat source generates heat by utilizing an exothermic reaction between two chemicals (e.g., quicklime and water), to heat the tobacco material or the flavor generator. In the smoking article substitutes of Patent Documents 16 and 17, the heat source generates heat by utilizing the heat of oxidation reaction of metal, to heat the tobacco material or the flavor generator.

The smoking article substitutes disclosed in Patent Documents 18 to 21 are all provided with a heat source utilizing electrical energy. Namely, the heat source converts electrical energy to heat energy, which is used to heat the tobacco material or the flavor generator.

With regard to the smoking article substitute disclosed in Patent Document 22, additives to be added to the tobacco material and heating conditions for heating the additives are defined with a view to heightening the flavor component releasing effect.

PRIOR ART LITERATURE

Patent Document 1: JP H02-2331 A1
Patent Document 2: JP S63-35468 A1
Patent Document 3: JP H06-46818 A1
Patent Document 4: JP H03-45658 B1
Patent Document 5: JP 3012253 B1
Patent Document 6: JP H02-84164 A1
Patent Document 7: JP 3013914 B1
Patent Document 8: WO 2009/22232
Patent Document 9: WO 2008/113420
Patent Document 10: JP 2006-504065 A1
Patent Document 11: WO 2007/12007
Patent Document 12: WO 2009/79641
Patent Document 13: JP 2008-35742 A1
Patent Document 14: U.S. Pat. No. 4,892,109 B1
Patent Document 15: JP H02-190171 A1
Patent Document 16: JP H06-114105 A1
Patent Document 17: WO 2009/92862
Patent Document 18: U.S. Pat. No. 5,144,962 B1
Patent Document 19: U.S. Pat. No. 5,060,671 B1
Patent Document 20: WO 2004/80216
Patent Document 21: JP 2006-525798 A1
Patent Document 22: JP S62-501050 A1

DISCLOSURE OF THE INVENTION

Problems to be Solved by the Invention

In the case of the smoking article substitute of Patent Document 1, no smoke is produced from the tobacco material, but the amount of the flavor components released from the tobacco material is small, so that the user will not be completely satisfied with the flavor derived from the tobacco material.

In this connection, in the smoking article substitutes of Patent Documents 2 to 21, the tobacco material or the flavor generator is heated, thus allowing a large amount of flavor components to be released from the tobacco material or the flavor generator, compared with the smoking article substitute of Patent Document 1. It is therefore thought that the user will be able to enjoy the flavor to an extent equivalent to that to which the user senses when smoking an ordinary filter cigarette. Since the heating of the tobacco material or the flavor generator is accompanied by the generation of aerosol, however, the smoking article substitutes of Patent Documents 2 to 21 are not perfectly smokeless.

On the other hand, the smoking article substitute of Patent Document 22 is smokeless and at the same time is capable of releasing an increased amount of flavor components. In the case of the smoking article substitute of Patent Document 22, however, it is necessary that a large amount of water should be contained in the tobacco material. Specifically, the water content needs to be 0.25 to 7 g, preferably, 1 to 5 g per gram of the tobacco material.

In the case of ordinary filter cigarettes, the water content per gram of the tobacco material is 0.1 to 0.15 g, and even in snuff having a relatively high water content such as snus, the upper-limit water content per gram of the tobacco material is 0.5 g or thereabout from the standpoint of preservative quality. In view of this, the smoking article substitute of Patent Document 22 is not suitable for commercial realization from the standpoint of the preservative quality of the tobacco material.

Aside from the preservative quality, the water content of the tobacco material decreases due to the heating of the tobacco material. Thus, as the user repeatedly inhales, the amount of the flavor components released from the tobacco material varies, which brings a feeling of strangeness to the user.

An object of the present invention is to provide a smokeless flavor inhalator permitting compatibility between smokelessness and strengthening of flavor and also capable of stabilizing the amount of flavor components released each time the user inhales through the flavor inhalator.

Means for Solving the Problems

To achieve the above object, the present invention provides a smokeless flavor inhalator comprising: a casing having a mouthpiece, the casing being configured to generate a flow of air guided therethrough toward the mouthpiece when a user inhales through the mouthpiece; a flavor generator arranged inside the casing and capable of releasing a flavor component into the air flow; and a heater for keeping the flavor generator heated at a heating temperature of 50 to 200° C., to allow the flavor component to be released while preventing generation of aerosol from the flavor generator, wherein the heater includes a carbon heat source having air permeability and attached to a distal end of the casing for heating the air, and an incombustible cooling element having air permeability and arranged inside the casing and between the carbon heat source and the flavor generator for cooling the air heated by the carbon heat source.

In the above smokeless flavor inhalator, the heater keeps the heating temperature of the flavor generator at a temperature of 50 to 200° C. Accordingly, when the user inhales through the flavor inhalator, the flavor generator releases the flavor component into the air flow guided toward the mouthpiece, without generating any aerosol (smoke). The flavor inhalator is therefore not only smokeless but is capable of delivering the flavor component into the user's mouth.

Preferably, the cooling element has a plurality of through holes formed therethrough, and the through holes provide the cooling element with a heat exchange area of 500 $mm^2$ or more. The presence of the cooling element serves to shorten the distance required between the carbon heat source and the flavor generator, making it possible to reduce the length of the flavor inhalator.

More detailed and preferred constructions of the present invention will become apparent from the following description of the embodiments and modifications taken in conjunction with the accompanying drawings.

Advantageous Effects of the Invention

The smokeless flavor inhalator of the present invention permits flavor components to be effectively released from the flavor generator without an aerosol being generated from the flavor generator, whereby the flavor components of the flavor generator can be adequately delivered into the user's mouth.

BEST MODE FOR CARRYING OUT THE INVENTION

Figure 1:
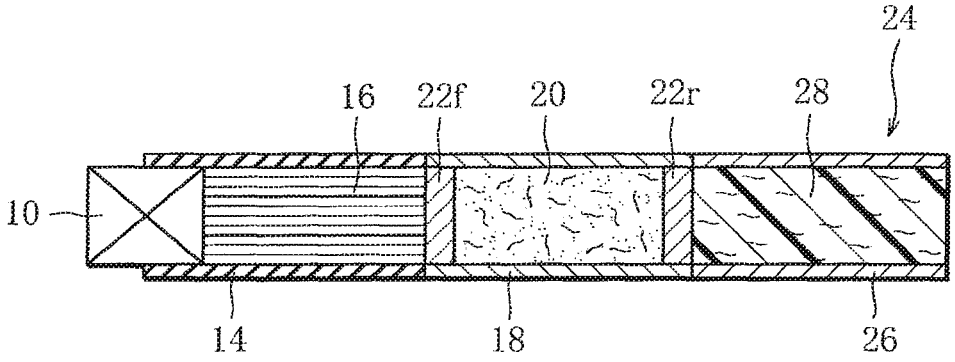
FIG. 1 is a longitudinal sectional view of a smokeless flavor inhalator according to a first embodiment.

A smokeless flavor inhalator according to a first embodiment, illustrated in FIG. 1, is categorized as Carbon Combustion+High-temperature Gas Heating+Cooling type and is shaped like a rod as a whole.

Carbon Heat Source:

The inhalator of FIG. 1 has a carbon heat source 10 at a distal end thereof. In the following, the carbon heat source 10 will be described in detail.

The carbon heat source 10 is cylindrical in shape and is obtained by molding a mixture of high-purity carbon particles, an incombustible additive, an organic or inorganic binder, and water into shape. Specifically, the carbon heat source 10 has a carbon ratio of 10 to 99 weight % or a carbon content of 1 to 120 mg/mm.

The high-purity carbon particles are obtained, for example, by heating carbon at a high temperature of 750° C. or more for 5 minutes or more in an inert gas atmosphere. This heating process removes volatile components, which are impurities contained in carbon particles. As a result, odor emitted from the carbon particles is lessened.

For the incombustible additive, carbonates or oxides of sodium, potassium, calcium, magnesium and silicon may be used. The incombustible additive accounts for 40 to 89 weight % of the carbon heat source 10. Preferably, calcium carbonate is used as the incombustible additive. The incombustible additive is optional and may be omitted.

The organic binder is one, or a mixture of two or more, of alginates, CMC, EVA, PVA, PVAC and sugars, and accounts for 1 to 10 weight % of the carbon heat source 10. A preferred organic binder is ammonium alginate.

For the inorganic binder, on the other hand, mineral-based binders, such as refined bentonite, or silica-based binders, such as colloidal silica, water glass and calcium silicate, may be used. The inorganic binder accounts for 5 to 20 weight % of the carbon heat source 10.

The inorganic binder is superior to the organic binder in that the former emits no smoke when the carbon heat source 10 is burned. Where the organic binder is used, the carbon heat source 10 is preferably obtained by a carbonizing-and-baking process. The carbonizing-and-baking process removes the organic binder from the carbon heat source 10, and therefore, the carbon heat source 10 does not emit odor when burned. The carbonizing-and-baking process is described in detail in, for example, JP 3024703 B1.

Figure 2:
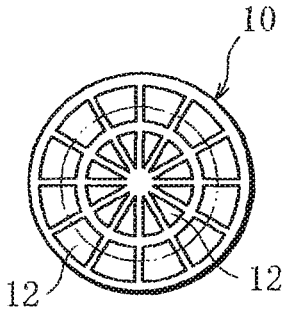
FIG. 2 exemplifies an end face of a carbon heat source.
Figure 3:
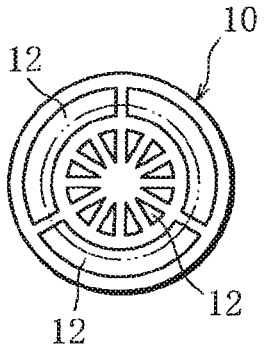
FIG. 3 exemplifies another end face of the carbon heat source.
Figure 4:
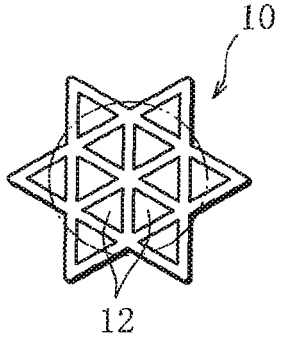
FIG. 4 exemplifies still another end face of the carbon heat source.

The carbon heat source 10 has at least one through hole 12 extending in an axial direction thereof. FIGS. 2 to 4 each illustrate an exemplary concrete shape of an end face of the carbon heat source 1. As clearly shown in FIGS. 2 to 4, adjacent ones of the through holes 12 are set apart from each other by a partition wall. In this case, the partition wall has a thickness of 0.1 to 0.5 mm.

Heat Source Holder:

The carbon heat source 10 is attached to a distal end of a heat source holder 14. In the following, the heat source holder 14 will be described in detail.

The heat source holder 14 has heat resistance and is tubular in shape. Preferably, the heat source holder 14 holds the carbon heat source 10 in such a manner that a predetermined length of the carbon heat source 10 projects from the distal end of the heat source holder 14.

The heat source holder 14 has a peripheral wall with a laminated structure, for example. Specifically, the peripheral wall is constituted by a single laminate including a metal layer and a paper layer bonded together, or by a plurality of such laminates superposed one upon the other in a radial direction of the heat source holder 14. An inner surface of the peripheral wall has to be constituted by the metal layer. The metal layer is made of an aluminum alloy, for example, and the total thickness of the metal layers included in the peripheral wall is preferably larger than or equal to 30 μm. The paper layer may be obtained from wrapper paper used for cigarettes, tip paper used for filter-tipped cigarettes, or other paper material such as ordinary paper, incombustible paper and flame-resistant paper.

The metal layer has excellent heat conductivity. Accordingly, when the carbon heat source 10 is burned and thus the paper layer is heated by the heat from the carbon heat source 10, the metal layer keeps the heating temperature of the paper layer lower than the burning temperature of the paper layer. The emission of odor due to scorching of the paper layer can therefore be suppressed.

Instead of the peripheral wall with the aforementioned laminated structure, the heat source holder 14 may have a peripheral wall made of an incombustible material, or a composite peripheral wall including a wall section constituted by the aforementioned peripheral wall with the laminated structure and a wall section made of an incombustible material. For the incombustible material, one of inorganic materials including ceramics, meerschaums, glass and metals or a mixture of two or more of the inorganic materials may be used.

Cooling Section:

The heat source holder 14 accommodates a cooling element 16. The cooling element 16 has air permeability and heat resistance and is located adjacent to the carbon heat source 10. In the following, the cooling element 16 will be described in detail.

The cooling element 16 is made of an inorganic material such as ceramics, meerschaums, glass, metals and calcium carbonate, hydrates, or water absorptive polymers. Specifically, the cooling element 16 has a honeycomb structure, a foamed structure or a packing structure, the packing structure being obtained by packing pellets or a granular or fibrous material into a mold. More specifically, the cooling element 16 includes internal passages. These internal passages have a total inner surface or a heat exchange area of 500 $mm^2$ or more. Preferably, the cooling element 16 contains the inorganic material of 90 to 95 wt %.

The cooling element 16 may alternatively have a composite structure including two or more different structures selected from the above structures, and the different structures may be juxtaposed so as to be closely adjacent to each other or with a space therebetween in the axial direction of the heat source holder 14. The cooling element 16 may contain water, an aromatic, an extraction liquid of tobacco components, and the like.

Material Holder:

A material holder 18 is coupled to the proximal end of the heat source holder 14. The material holder 18 has heat resistance and is tubular in shape. The material holder 18 is made of paper, metal or synthetic resin, or is formed using the laminated structure of the aforementioned laminates.

Tobacco Material:

A tobacco material 20, as a flavor generator, is contained in the material holder 18. The tobacco material 20 may be ordinary shredded tobacco used for cigarettes, granular tobacco used for snuff, rolled tobacco, or molded tobacco.

The rolled tobacco is obtained by forming a sheet of reconstituted tobacco into a roll and has channels therein. The molded tobacco is obtained by molding granular tobacco into shape.

The tobacco material 20 may be admixed with a flavor-developing aid. The flavor-developing aid contains at least one of carbonates, hydrogen carbonates, oxides and hydroxides of alkali metals and/or alkaline-earth metals. A preferred flavor-developing aid is potassium carbonate. The tobacco material 20 may further contain a desired aromatic or aromatics.

Specifically, the tobacco material 20 is 5 to 30 mm in length and has a resistance of 10 to 120 mmAq to draw. It is to be noted here that the tobacco material 20 has a water content equivalent to that of shredded tobacco used in ordinary cigarettes, that is, a water content of 10 to 20 weight %.

In this embodiment, the tobacco material 20 is held between front and rear stoppers 22*f* and 22*r* to be kept within the material holder 18. Each of the stoppers 22*f* and 22*r* is shaped like a disk and has air permeability. Specifically, the stoppers 22*f* and 22*r* are fitted into respective opposite ends of the material holder 18 and are each made of a filter material such as acetate and paper, or a membrane material such as nonwoven fabric, or formed using an inorganic molded piece having air permeability.

Mouthpiece:

A mouthpiece 24 is connected to a rear end of the material holder 18. The mouthpiece 24 includes a tubular filter holder 26. The filter holder 26 is made of paper or a synthetic resin and has a rear end forming a mouthpiece.

A filter 28 is accommodated in the filter holder 26. The filter 28 is in the form of a solid cylinder and is made of acetate fibers, paper or the like. Acetate fibers and paper have the property of not readily adsorbing the flavor components of the tobacco material 20. The filter 28 may have at least one through hole axially extending therethrough. Further, the filter 28 may be a combination of different kinds of filter materials, like dual filters and the like for cigarettes.

To use the flavor inhalator of the first embodiment, the user first lights the carbon heat source 10 of the flavor inhalator and then inhales with the mouthpiece 24 held in his/her mouth. The inhalation creates a flow of air from the outside of the flavor inhalator into the user's mouth cavity through the through holes 12 of the carbon heat source 10, the cooling element 16 in the heat source holder 14, the front stopper 22*f*, the tobacco material 20, the rear stopper 22*r*, the filter 28 and the mouthpiece 24.

While passing through the through holes 12 in the carbon heat source 10, the air flow is heated by the combustion heat of the carbon heat source 10. Accordingly, the air flow just left the carbon heat source 10 forms a high-temperature gas flow.

The high-temperature gas flow is cooled in some degree while passing through the cooling element 16, thus turning to a heated gas flow. The heated gas flow heats the tobacco material 20 when passing through the tobacco material 20, but the heating of the tobacco material 20 by the heated gas flow does not lead to burning of the tobacco material 20 or generation of aerosol (smoke) from the tobacco material 20.

Specifically, the heating temperature of the tobacco material 20 is kept within a temperature range of 50 to 200° C. This temperature range is higher than an ambient temperature (concretely, 5 to 35° C.) at which the flavor inhalator is used, but is sufficiently lower than the heating temperature of the carbon heat source 10. Namely, the cooling element 16 has the function of lessening the amount of heat transferred from the carbon heat source 10 to the tobacco material 20.

Where the heating temperature of the tobacco material 20 is kept within the above temperature range, liquid contained in the tobacco material 20, such as water, is not aerosolized and the flavor components of the tobacco material 20 are satisfactorily released into the heated gas flow passing through the tobacco material 20. Moreover, the aforementioned flavor-developing aid promotes the release of the flavor components from the tobacco material 20 into the heated gas flow; on the other hand, the amount of the flavor components adsorbed by the filter 28 of the mouthpiece 24 is small.

Consequently, the flavor inhalator allows the heated gas flow containing a large amount of the flavor components of the tobacco material 20 to be delivered into the user's mouth cavity without generating an aerosol, so that the user can fully enjoy the flavor of the tobacco material 20.

When the carbon heat source 10 is burned, the generation of smoke from the carbon heat source 10 is minimized as stated above, and therefore, the carbon heat source 10 also does not constitute a source of aerosol (smoke).

The term "smokeless" used herein means that the aerosol generated from the flavor inhalator during use has a concentration of $1.0\times10^5$ particles/cc or less. Aerosol with such a concentration is substantially invisible and the concentration is virtually unmeasurable because of the influence of the background of ambient air.

The water content of the tobacco material 20 is equivalent to that of shredded tobacco contained in ordinary cigarettes. Accordingly, although the tobacco material 20 is heated to a temperature falling within the aforementioned temperature range and its water content varies as a result, the amount of the flavor components in the heated gas flow inhaled per puff of the user is almost constant. As a result, the user can enjoy the flavor of the tobacco material 20 reliably and stably even if he/she repeatedly puffs.

Where an aromatic or aromatics different from the tobacco-specific flavor components are contained in the tobacco material 20, the user can of course enjoy the aromatic or aromatics at the same time.

In the first embodiment described above, the heat source holder 14, the material holder 18 and the filter holder 26 constitute a casing of the flavor inhalator. Of these holders 14, 18 and 26 connected to one another, at lease two of the holders may be formed as a one-piece body, or adjacent ones of the holders may be previously connected to each other by tip paper or the like. Further, the holders may be detachably connected to one another.

The present invention is not limited to the aforementioned first embodiment and may be modified in various ways.

In the following, various modifications and other embodiments will be described in order. In the following description, identical reference signs are used to denote members or sections having functions identical with those of the members or sections already explained above, and description of such members and sections is omitted for brevity's sake. The following description is focused on the differences.

Figure 5:
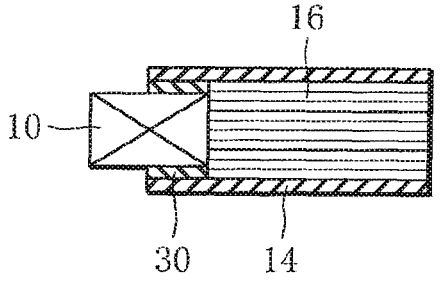
FIG. 5 is a longitudinal sectional view of a heat source holder according to modification 1(1) of the first embodiment.

FIG. 5 illustrates modification 1(1) of the flavor inhalator of the first embodiment.

In modification 1(1), as is clear from FIG. 5, a heat insulator 30 is arranged between the carbon heat source 10 and the heat source holder 14. The heat insulator 30 is tubular in shape and is made of an inorganic material such as inorganic fibers, or formed using an inorganic molded piece, for example.

The heat insulator 30 reduces the transfer of heat from the carbon heat source 10 to the heat source holder 14 and prevents the generation of smoke due to scorching of the heat source holder 14. Also, the heat insulator 30 may be so arranged as to surround the entire outer periphery of the carbon heat source 10. In this case, smoke, if produced in a small amount due to the combustion of the carbon heat source 10, is dispersed within the heat insulator 30 and does not become visible.

Figure 6:
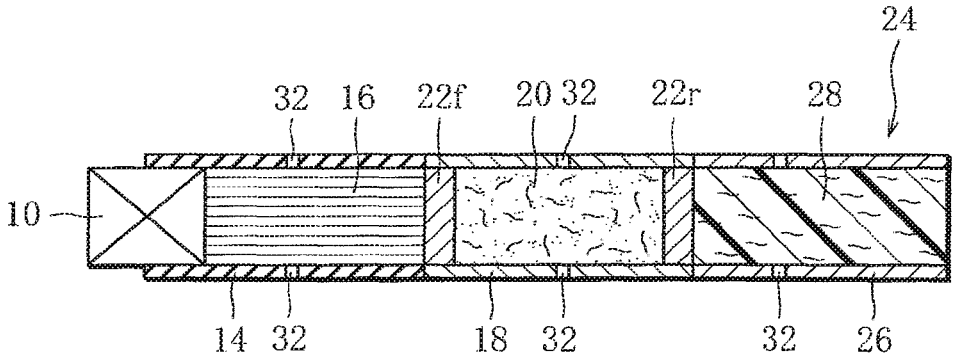
FIG. 6 is a longitudinal sectional view of a flavor inhalator according to modification 1(2) of the first embodiment.

FIG. 6 illustrates modification 1(2) of the smokeless flavor inhalator of the first embodiment.

In modification 1(2), the flavor inhalator has a plurality of air inlet holes 32 formed in at least one of the heat source holder 14, the material holder 18 and the filter holder 26. The air inlet holes 32 are located downstream of the carbon heat source 10 and are arranged at intervals in the circumferential direction of the corresponding holder. Specifically, in modification 1(2) illustrated in FIG. 6, the air inlet holes 32 are formed in each of the heat source holder 14, the material holder 18 and the filter holder 26.

When the user inhales through the mouthpiece 24 of the flavor inhalator of FIG. 6, outside air flows into the corresponding holder through the air inlet holes 32. This inflow of air reduces the flow rate of the aforementioned high-temperature gas flow or heated gas flow, and the air thus introduced mixes with the high-temperature gas flow or the heated gas flow, lowering the temperature of the high-temperature gas flow or the heated gas flow. That is, the air introduced through the air inlet holes 32 adds to the cooling function of the cooling element 16 and is very effective in keeping the heating temperature of the tobacco material 20 within the aforementioned temperature range.

Figure 7:
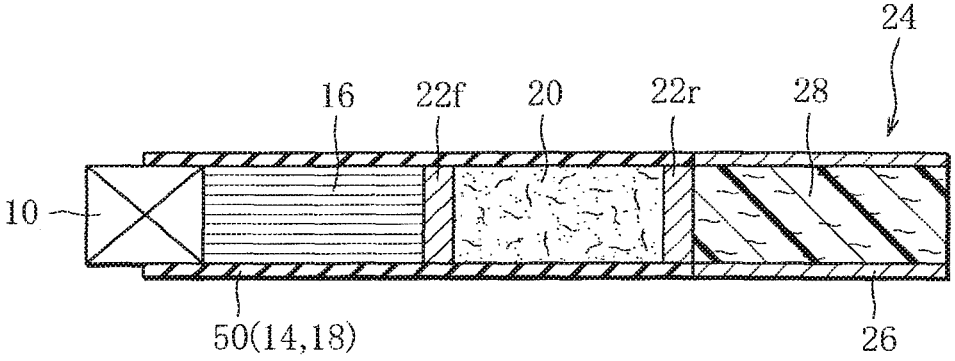
FIG. 7 is a longitudinal sectional view of a smokeless flavor inhalator according to a second embodiment.

FIG. 7 illustrates a smokeless flavor inhalator according to a second embodiment.

Specifically, the flavor inhalator of FIG. 7 is categorized as Carbon Combustion+High-temperature Gas/Thermal Conduction Heating+Cooling type.

The flavor inhalator of the second embodiment is provided with a heat conduction holder 50. The heat conduction holder 50 not only serves as both of the heat source holder 14 and the material holder 18 but has the function of transferring the heat of the carbon heat source 10 to the tobacco material 20. Accordingly, the heat conduction holder 50 is made of a highly heat-conductive material.

In the second embodiment, even while the supply of the heated gas flow from the carbon heat source 10 to the tobacco material 20 is stopped between a user's puff and another, the heat conduction holder 50 allows heat to be transferred from the carbon heat source 10 to the tobacco material 20. Thus, even during the period between a user's puff and another, the tobacco material 20 is continuously heated to emit the flavor components having a rich taste and aroma.

Figure 8:
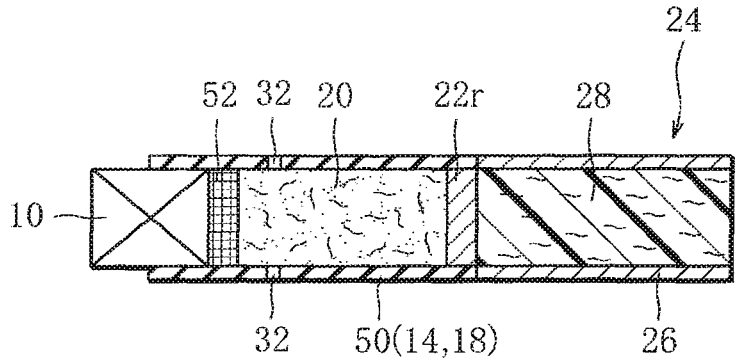
FIG. 8 is a longitudinal sectional view of a smokeless flavor inhalator according to a third embodiment.

FIG. 8 illustrates a smokeless flavor inhalator according to a third embodiment. This flavor inhalator is categorized as Carbon Combustion+Thermal Conduction Heating type.

The flavor inhalator of the third embodiment is also provided with the heat conduction holder 50 but uses an incombustible element 52, in place of the cooling element 16 and the front stopper 22*f*

The incombustible element 52 has air impermeability and heat resistance. Specifically, the incombustible element 52 is constituted by a filler of inorganic fibers or an inorganic molded piece and, as clearly shown in FIG. 8, is interposed between the carbon heat source 10 and the tobacco material 20 within the heat conduction holder 50.

Since the incombustible element 52 is impermeable to air, the heat conduction holder 50 has a plurality of air inlet holes 32 formed in the outer periphery thereof.

In the flavor inhalator of the third embodiment, heat generated by the combustion of the carbon heat source 10 is transferred to the tobacco material 20 only through the heat conduction holder 50, and the tobacco material 20 is heated to a temperature within the aforementioned temperature range only by the thus-transferred heat. That is, the heat conduction holder 50 performs a function similar to that of the aforementioned cooling element 16. In this case, it is unlikely that the user will inhale the combustion gas produced by the combustion of the carbon heat source 10.

In the third embodiment, the carbon heat source 10 need not have air permeability. Where the carbon heat source used is impermeable to air, the incombustible element 52 may have air permeability. Thus, in the case of the third embodiment, either the carbon heat source 10 or the incombustible element 52 has only to be impermeable to air, in order to prevent the combustion gas from flowing into the tobacco material 20.

Also, where air permeability is imparted to the carbon heat source 10, the carbon heat source 10 preferably has a circular cross section, as illustrated in FIG. 2 or 3. The carbon heat source 10 illustrated in FIG. 2 or 3 has a large effective heat transfer area with respect to the inner peripheral surface of the heat conduction holder 50, compared with the carbon heat source 10 shown in FIG. 4.

Figure 9:
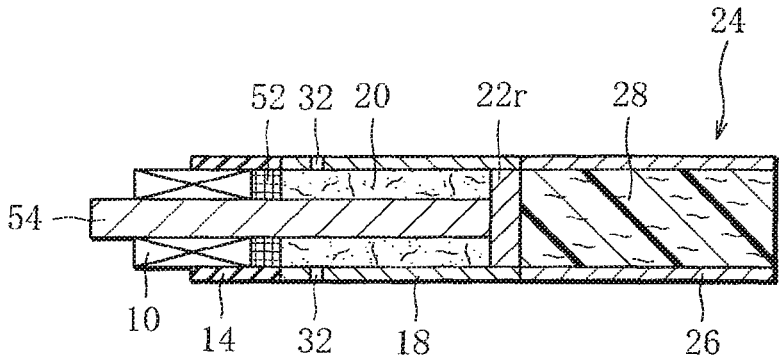
FIG. 9 is a longitudinal sectional view of a flavor inhalator according to modification 3(1) of the third embodiment.

FIG. 9 illustrates modification 3(1) of the flavor inhalator of the third embodiment.

In modification 3(1), the flavor inhalator is provided with a heat conduction rod 54, in place of the heat conduction holder 50. The heat conduction rod 54 extends through the carbon heat source 10, the incombustible element 52 and the tobacco material 20 in their center and has an outer end projecting from the carbon heat source 10 and an inner end disposed in contact with the rear stopper 22*r*. In the case of modification 3(1), therefore, the carbon heat source 10, the incombustible element 52 and the tobacco material section 20 are each tubular or annular in shape.

The heat conduction rod 54 is made of a metal having high heat conductivity, for example, an aluminum alloy, and is a solid member or a hollow member with at least one end closed. Compared with the solid heat conduction rod, the hollow heat conduction rod 54 has small heat capacity and thus is capable of satisfactorily and quickly conducting heat from the carbon heat source 10 to the tobacco material 20. The heat conduction rod 54 may, in this case, have an outer diameter of 1 to 5 mm, and the length of the tobacco material section 20 may be 5 to 50 mm.

Figure 10:
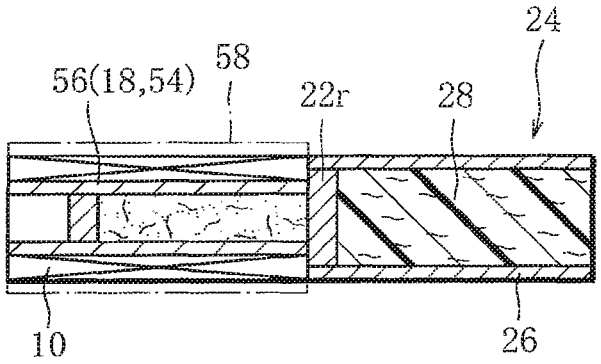
FIG. 10 is a longitudinal sectional view of a flavor inhalator according to modification 3(2) of the third embodiment.

FIG. 10 illustrates modification 3(2) of the flavor inhalator of the third embodiment.

In modification 3(2), a heat conduction pipe 56 is arranged inside the hollow carbon heat source 10 coaxially therewith. The heat conduction pipe 56 serves as both of the material holder 18 and the heat conduction rod 54.

Specifically, the heat conduction pipe 56 has an air inlet opening located at a distal end face of the carbon heat source 10, and the front stopper 22*f* is fitted into the distal end portion of the heat conduction pipe 56. A gap of 5 mm or more is provided between the front stopper 22*f* and the air inlet opening. The gap serves to reliably prevent the tobacco material 20 from burning when the carbon heat source 10 is lighted.

The carbon heat source 10 is surrounded by an outer heat insulator 58. The outer heat insulator 58 is in the form of a thin pipe and has air permeability, that is, breathability. The outer heat insulator 58 serves to reduce the radiation of heat from the carbon heat source 10, thereby making it possible to keep the amount of heat necessary for sustaining the combustion of the carbon heat source 10, and thus is very effective in securing combustion sustention of the carbon heat source 10.

In cases where the heat conduction pipe 56 has such high heat conductivity that the tobacco material 20 may possibly be heated to a temperature above the aforementioned temperature range, an insulator in the form of a thin pipe (not shown) is arranged between the carbon heat source 10 and the heat conduction pipe 56, and/or between the heat conduction pipe 56 and the tobacco material 20. The heat conduction pipe 56 has an outer diameter of 3 to 8 mm and an inner diameter of 2 to 7 mm.

Figure 11:
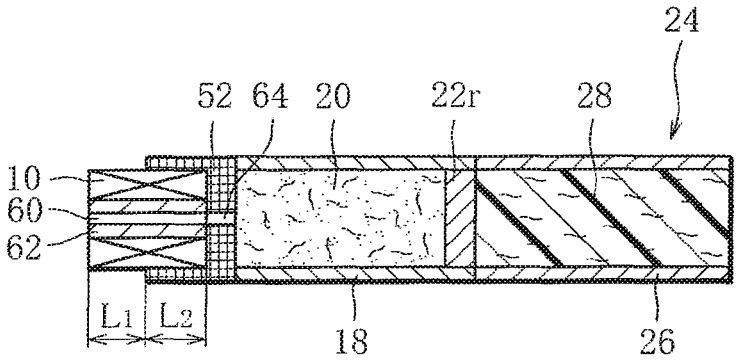
FIG. 11 is a longitudinal sectional view of a smokeless flavor inhalator according to a fourth embodiment.

FIG. 11 illustrates a smokeless flavor inhalator according to a fourth embodiment. This flavor inhalator is categorized as Carbon Combustion+Air Heating type.

In the fourth embodiment, the carbon heat source 10 has an air inlet hole 60 formed in the center thereof. The air inlet hole 60 axially penetrates through the carbon heat source 10.

Further, the carbon heat source 10 has a heat-resistant coating 62 covering the entire inner surface of the air inlet hole 60. The heat-resistant coating 62 may be made of clay, or a metal oxide such as iron oxide, alumina, titania, silica, silica-alumina, zirconia and zeolite, or a mixture of clay and two or more of the mentioned metal oxides.

Further, the incombustible element 52 has a through hole 64 formed in the center thereof and connected to the air inlet hole 60. As is clear from FIG. 11, the incombustible element 52 has an extension surrounding the rear end portion of the carbon heat source 10. In this case, the incombustible element 52 serves also as the heat source holder 14. In FIG. 11, the reference sign $L_1$ represents a projection length of the carbon heat source 10 projecting from the incombustible element 52, and the reference sign $L_2$ represents an overlap length (length of the extension) of the incombustible element 52 overlapping with the carbon heat source 10.

With the flavor inhalator of the fourth embodiment, when the user inhales through the mouthpiece 24 after lighting the carbon heat source 10, air flows into the tobacco material 20 through the air inlet hole 60 of the carbon heat source 10 and the through hole 64 of the incombustible element 52, and the air is heated to a temperature within the aforementioned temperature range in the process of passing through the carbon heat source 10. Thus, the flavor inhalator of this embodiment also permits the flavor components of the tobacco material 20 to be adequately delivered into the user's mouth cavity without generating an aerosol.

Figure 12:
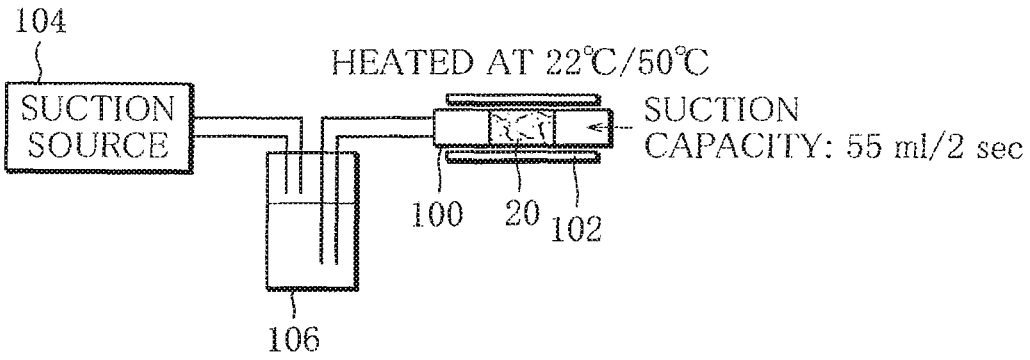
FIG. 12 schematically illustrates a first testing device.

As will be clear from the above, the smokeless flavor inhalator of the present invention requires that the tobacco material 20 be heated to a temperature of 50° C. to 200° C. while the inhalator is in use. For the purpose of verification, a first testing device shown in FIG. 12 was prepared.

The first testing device is provided with a heat resistant tube 100 accommodating the tobacco material 20, and a heater 102 surrounding the tube 100 and capable of heating the tube 100, namely, the tobacco material 20, up to 22° C. or 50° C. The tobacco material 20 subjected to the test contained 230 mg of tobacco particles made from Burley tobacco leaves and 14 mg of potassium carbonate. The tobacco particles had a particle diameter of 0.5 to 1.18 mm.

The first testing device is further provided with a suction source 104, which is connected to the tube 100 through an impinger 106. The suction source 104 is configured to draw in air or a gas from the tube 100 through the impinger 106 at a flow rate of 55 ml/2 sec (corresponding to one puff).

With the tobacco material 20 heated to 22° C., the suction gas was drawn to the suction source 104 while being allowed to bubble in the impinger 106 so that a flavor component (nicotine) of the tobacco material contained in the suction gas might be collected in the impinger 106. As a result, it was found that the amount of the collected flavor component was 0.7 μg/puff.

Further, with the tobacco material 20 heated to 50° C., the flavor component was collected in the impinger 106 in the same manner, and it was found that the amount of the collected flavor component was 9.0 μg/puff.

The above two test results reveal that when the tobacco material 20 is heated to a temperature of 50° C., the amount of the flavor component released is more than one digit larger than when the tobacco material 20 is heated to 20° C. This proves that the tobacco material 20 needs to be heated to 50° C. or higher in order to deliver an adequate amount of the flavor component into the user's mouth.

Figure 13:
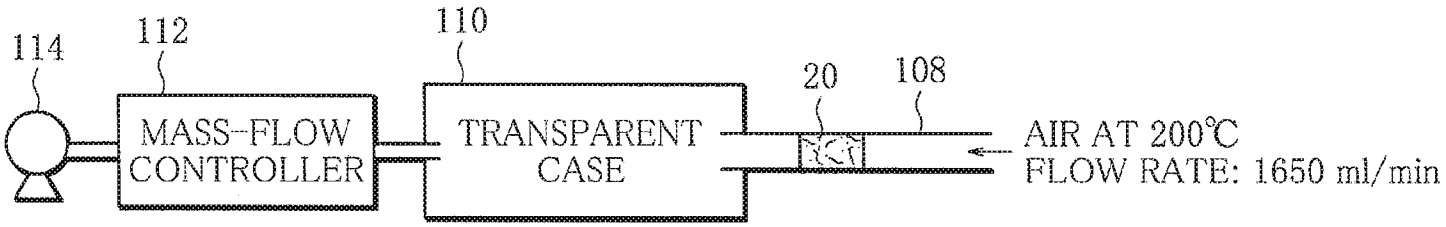
FIG. 13 schematically illustrates a second testing device.

FIG. 13 illustrates a second testing device.

The second testing device is provided with a heat resistant tube 108 accommodating the tobacco material 20. The tobacco material 20 subjected to the test contained 35 mg of tobacco particles made from Burley tobacco leaves, and the tobacco particles had a particle diameter of 0.5 to 1.18 mm.

The tube 108 is connected through a transparent case 110 and a mass-flow controller 112 to a suction pump 114, which is capable of drawing in air from the tube 108 at a flow rate of 1,650 ml/min.

Suction of air by means of the suction pump 114 at the mentioned flow rate was repeated while gradually raising the temperature of the air flowing into the tube 108, and as a result, it was confirmed that no aerosol (smoke) was observed inside the transparent case 110 insofar as the temperature of the air, that is, the temperature of the tobacco material 20, was 200° C. or less. This guarantees that no smoke is generated from the tobacco material 20 as long as the heating temperature of the tobacco material 20 is kept at 200° C. or lower.

Figure 14:
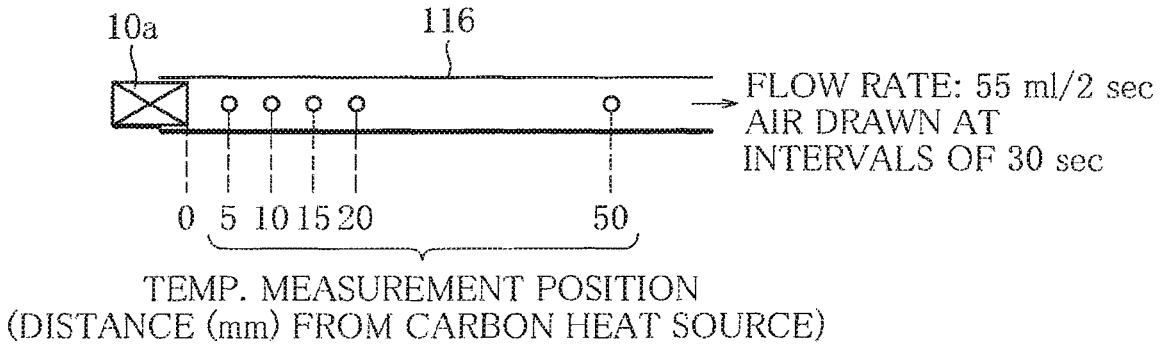
FIG. 14 schematically illustrates a third testing device.

Further, in the smokeless flavor inhalator of the present invention, the cooling element 16 needs to have the heat exchange area of 500 $mm^2$, as stated above. For the purpose of verification, a third testing device illustrated in FIG. 14 was prepared.

Figure 15:
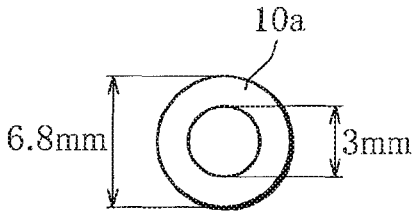
FIG. 15 is an end view of a carbon heat source used in the third testing device.
Figure 16:
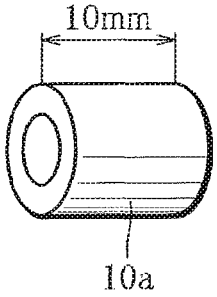
FIG. 16 is a perspective view of the carbon heat source of FIG. 15.

The third testing device is provided with a tube 116 made of heat resistant paper. The tube 116 has a hollow cylindrical carbon heat source 10*a* attached to a distal end thereof. The carbon heat source 10*a* subjected to the test was obtained by extrusion molding and contained 80 weight % of active carbon, 15 weight % of calcium carbonate, and 5 weight % of carboxymethylcellulose (CMC). Specifically, as illustrated in FIGS. 15 and 16, the carbon heat source 10*a* had an inner diameter of 3 mm, an outer diameter of 6.8 mm, and a length of 10 mm.

The proximal end of the tube 116 is connected to a suction source (not shown), and the suction source is configured to draw in air from the tube 116 at a flow rate of 55 ml/2 sec (corresponding to one puff) at intervals of 30 seconds. Further, the tube 116 has five temperature sensors (not shown) attached thereto. The temperature sensors are located at distances of 5 mm, 10 mm, 15 mm, 20 mm and 50 mm from the carbon heat source 10*a*, respectively, and are each capable of measuring the temperature in the tube 116.

While the suction of air by means of the suction source was repeated with the carbon heat source 10 lighted, the temperatures in the tube 116 were measured by the respective temperature sensors. The measurement results are shown in FIG. 17.

Figure 17:
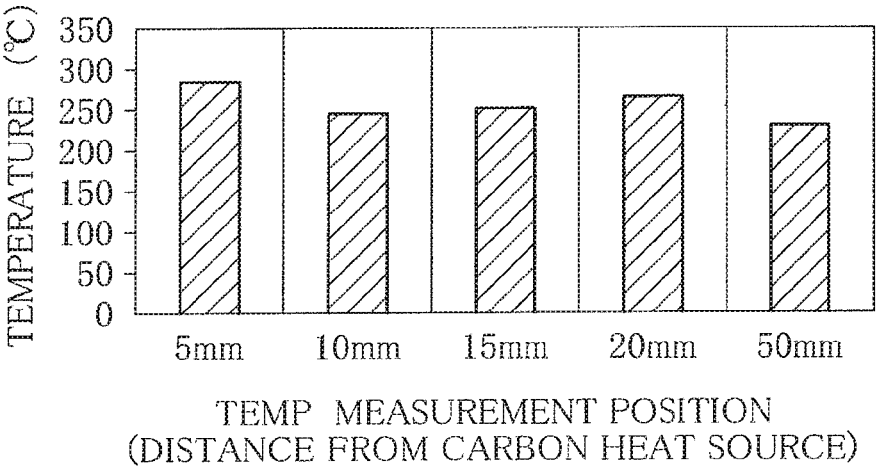
FIG. 17 is a graph showing test results obtained using the third testing device.

As is clear from FIG. 17, the temperature in the tube 116 shows a tendency to lower with increasing distance from the carbon heat source 10*a*, and in order for the temperature in the tube 116 to drop to 200° C. or less, a distance of 50 mm or more from the carbon heat source 10*a* is needed.

In other words, in the case of the third testing device not including the cooling element 16, a distance of 50 mm or more needs to be secured between the carbon heat source 10*a* and the tobacco material 20 in order to restrict the heating temperature of the tobacco material 20 to a temperature not higher than 200° C., at and below which generation of smoke (aerosol) from the tobacco material 20 can be avoided.

Thus, where the smokeless flavor inhalator does not include the cooling element 16, a distance of 50 mm or more needs to be provided between the carbon heat source 10*a* and the tobacco material 20. Such a flavor inhalator is, however, extraordinarily long and is not practical.

Figure 18:
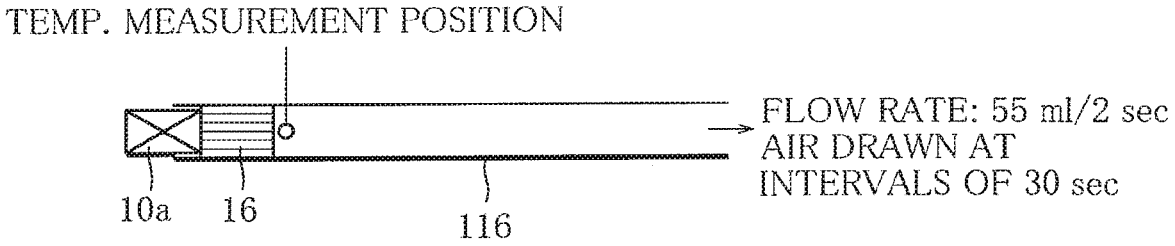
FIG. 18 schematically illustrates a fourth testing device.

FIG. 18 illustrates a fourth testing device prepared for verifying the function of the cooling element 16.

Compared with the third testing device, the fourth testing device includes the cooling element 16 having air permeability as well as heat resistance and arranged inside the tube 116 in a position adjacent to the carbon heat source 10*a*. The temperature sensor is arranged only at the outlet end (downstream end) of the cooling element 16 to measure the temperature in the tube 116 at the outlet of the cooling element 16.

Figure 19:
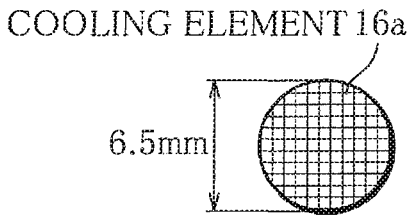
FIG. 19 is an end view of a cooling element used in the fourth testing device.
Figure 20:
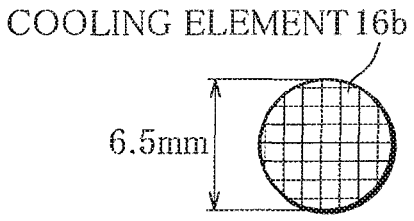
FIG. 20 is an end view of another cooling element used in the fourth testing device.

For use with the fourth testing device, multiple pieces of cylindrical cooling elements 16*a* and 16*b*, illustrated in FIGS. 19 and 20, respectively, were prepared. The cooling elements 16*a* and 16*b* were each obtained by extrusion molding and contained 95 weight % of calcium carbonate and 5 weight % of carboxymethylcellulose (CMC).

The cooling elements 16*a* and 16*b* are identical in outer diameter (6.5 mm) but are different in the opening area of their internal passages. Specifically, the cooling element 16*a* had an opening area of 17.2 $mm^2$ obtained, for example, by 52 through holes each with a square (0.57 mm×0.57 mm) cross-section. In this case, the total length of the inner perimeters of all through holes is 120 mm.

On the other hand, the cooling element 16*b* had an opening area of 24.1 $mm^2$ obtained, for example, by 21 through holes each with a square (1.23 mm×1.23 mm) cross-section. In this case, the total length of the inner perimeters of all through holes is 90.9 mm.

Since the heat exchange areas of the cooling elements 16*a* and 16*b* are each given by: inner perimeter×length, the cooling elements 16*a* and 16*b* with different lengths were prepared.

With one cooling element 16*a* set in the fourth testing device, a suction test was conducted in the same manner as that performed using the third testing device, and the suction test was repeated with respect to all cooling elements 16*a* with different lengths. Similarly, each of the cooling elements 16*b* with different lengths was subjected to the suction test.

Figure 21:
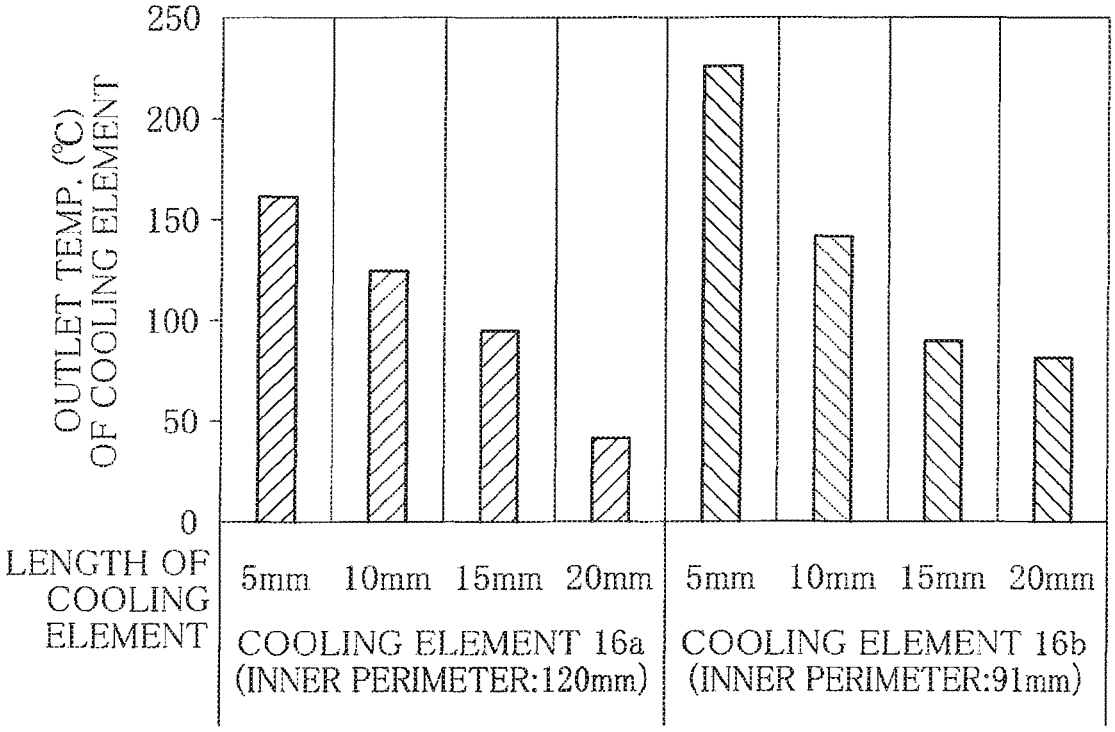
FIG. 21 is a graph showing test results obtained using the fourth testing device.
Figure 22:
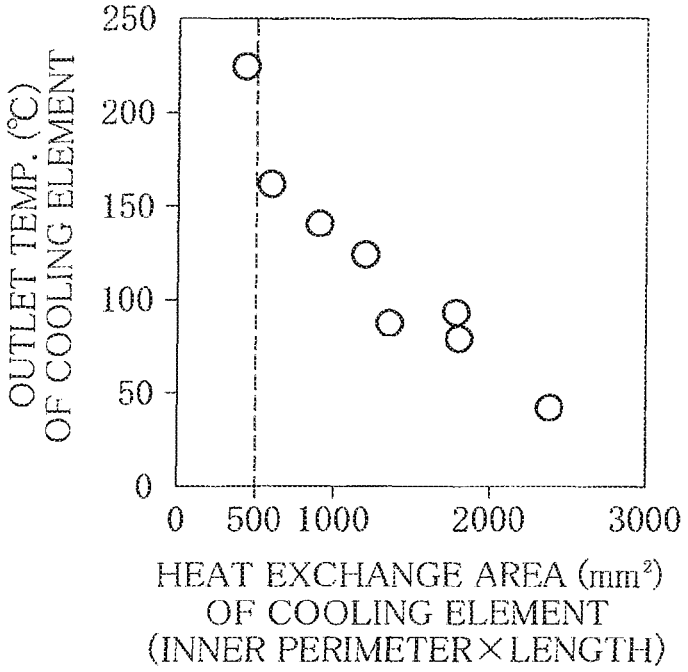
FIG. 22 is a graph showing the relations between heat exchange areas and outlet temperatures of the cooling element.

FIGS. 21 and 22 show the test results. As is clear from FIG. 21, the greater the length, the lower the outlet temperature of the cooling element 16 becomes, regardless of whether the cooling element tested is the cooling element 16*a* or the cooling element 16*b*.

With regard to the heat exchange areas of the cooling elements 16*a* and 16*b*, the test results indicate that a heat exchange area of 500 $mm^2$ is needed in order to keep the outlet temperature of the cooling element 16, that is, the heating temperature of the tobacco material 20, at 200° C. or below. In the case of the cooling element 16*a*, a heat exchange area of 500.4 $mm^2$ (=120 mm×4.17 mm) or more can be ensured if the cooling element 16*a* has a length of 4.17 mm or more. In the case of the cooling element 16*b*, on the other hand, a heat exchange area of 500.5 $mm^2$ (=91 mm×5.5 mm) or more can be ensured if the cooling element 16*b* has a length of 5.5 mm or more.

Thus, by including the cooling element 16*a* or 16*b* in the smokeless flavor inhalator, it is possible to significantly shorten the distance (length of the cooling element 16*a* or 16*b*) needed between the carbon heat source 10 and the tobacco material 20, so that the overall length of the smokeless flavor inhalator can be reduced to a practical level.

The cooling element 16*a* or 16*b* located between the carbon heat source 10 and the tobacco material 20 need not be disposed in direct contact with the carbon heat source 10 or the tobacco material 20. A predetermined space may be provided between the carbon heat source 10 and the cooling element 16*a* or 16*b*, or between the cooling element 16*a* or 16*b* and the tobacco material 20.

The presence of the cooling element 16*a* or 16*b* makes it unnecessary to introduce outside air to the upstream side of the tobacco material 20, that is, into the region between the carbon heat source 10 and the tobacco material 20, in order to keep the heating temperature of the tobacco material 20 at a temperature not higher than 200° C., and also prevents the ignition performance of the carbon heat source 10 from being deteriorated due to the inflow of the outside air. Specifically, the introduction of outside air leads to reduction in the amount of the outside air passing through the carbon heat source 10 when the carbon heat source 10 is lighted, deteriorating the ignition performance of the carbon heat source 10.

The present invention is not limited to the embodiments and modifications described above and may be modified in various other ways.

For example, the flavor generator is not limited to the aforementioned tobacco material and may be a liquid or solid aromatic, other than the flavor components of the tobacco material, carried on a base material of cellulose or the like. Also, the flavor inhalator of the present invention may be implemented by optionally combining the elements in the aforementioned embodiments and modifications with commonly known means without departing from the purpose of the invention.

EXPLANATION OF REFERENCE SIGNS

10 carbon heat source
12 through hole (flow path)
14 heat source holder (casing)
16 cooling element
18 material holder
20 tobacco material (flavor generator)
24 mouthpiece
28 filter
30 heat insulator
32 air inlet hole (flow path)
50 heat conduction holder (casing)
52 incombustible element
54 heat conduction rod
56 heat conduction pipe
60 air inlet hole (flow path)

What is claimed is:

1. A flavor inhalator comprising:

a heat source;

a tobacco material located downstream of the heat source;

a housing having a constant outer diameter and a constant inner diameter, the housing comprising:

a first section formed by a heat source holder attached to at least a part of the heat source and a second section, wherein a peripheral wall of the heat source holder includes a first material including a first metal layer which constitutes an inner surface of the peripheral wall, a paper layer which is superposed on the first metal layer, and an incombustible material layer which is superposed on the paper layer, and wherein the second section is formed of a second material different than the first material.

2. The flavor inhalator according to claim 1, wherein the incombustible material layer is a second metal layer.

3. The flavor inhalator according to claim 1, wherein the incombustible material layer is a ceramic layer.

4. The flavor inhalator according to claim 1, wherein the incombustible material layer has a plurality of air inlet holes.

5. The flavor inhalator according to claim 4, wherein the plurality of air inlet holes are located downstream of the heat source.

6. The flavor inhalator according to claim 4, wherein the plurality of air inlet holes are arranged at intervals in a circumferential direction of the incombustible material layer.

7. The flavor inhalator according to claim 4, wherein the plurality of air inlet holes are arranged in a circumferential direction of a segment of the tobacco material.

8. The flavor inhalator according to claim 1, wherein the heat source need not have air permeability in order to prevent from inflow or outflow of a gas through the heat source.

9. The flavor inhalator according to claim 1, further comprising an air impermeability material arranged adjacent to the heat source.

10. The flavor inhalator according to claim 9, wherein the air impermeability material is interposed between the heat source and the tobacco material.

11. The flavor inhalator according to claim 1, wherein at least one metal layer of the heat source holder extends to a segment of the tobacco material and transfers heat of the heat source to the tobacco material.

12. The flavor inhalator according to claim 1, wherein at least one of the first metal layer and the incombustible material layer is made of an aluminum alloy.

13. The flavor inhalator according to claim 1, wherein the paper layer is obtained from incombustible paper.

14. The flavor inhalator according to claim 1, further comprising an air permeable stopper coupled to a downstream proximal end of a segment of the tobacco material.

15. The flavor inhalator according to claim 14, wherein the air permeable stopper is made of a filter material.

16. The flavor inhalator according to claim 14, further comprising a filter material coupled to downstream of the air permeable stopper.

17. The flavor inhalator according to claim 1, further comprising a cool section coupled to downstream of the heat source; wherein the cool section includes passages through which aerosol generated from the flavor inhalator is able to pass.

18. The flavor inhalator according to claim 1, further comprising a cool section coupled to downstream of the heat source; wherein the cool section has a total inner surface, which is able to contact aerosol generated from the flavor inhalator, as a heat exchange area of 500 $mm^2$ or more.

19. The flavor inhalator according to claim 1, wherein the second section is a material holder surrounding the tobacco material.

20. The flavor inhalator according to claim 1, further comprising a third section made of a different material than the first section and second section, wherein the second section is between the first section and third section.

* * * * *